US005873484A

United States Patent [19]

Clute et al.

[11] Patent Number: 5,873,484

[45] **Date of Patent: *Feb. 23, 1999**

[54] COVER LOCKING MECHANISM

[75] Inventors: Charles P. Clute; Darrell Davis, both of Indianapolis, Ind.

[73] Assignee: North America Packaging Corporation, Atlanta, Ga.

[ * ] Notice: This patent issued on a continued prosecution application filed under 37 CFR 1.53(d), and is subject to the twenty year patent term provisions of 35 U.S.C. 154(a)(2).

[21] Appl. No.: 705,813

[22] Filed: Aug. 30, 1996

[51] Int. Cl.[6] ..... B65D 41/48

[52] U.S. Cl. ..... 220/276; 220/793

[58] Field of Search ..... 220/270, 276, 220/780, 793, 805, 796; 215/250, 256, 254

[56] References Cited

U.S. PATENT DOCUMENTS

| | | | |
|---|---|---|---|
| 3,510,023 | 5/1970 | Ullman et al. . | |
| 4,281,774 | 8/1981 | Mumford | 215/256 X |
| 4,305,517 | 12/1981 | Dennis . | |
| 4,437,593 | 3/1984 | Bullock, III . | |
| 4,566,601 | 1/1986 | Kuenzig . | |
| 4,589,561 | 5/1986 | Crisci . | |
| 4,593,830 | 6/1986 | Bullock . | |
| 4,625,876 | 12/1986 | Bullock, III . | |
| 4,632,265 | 12/1986 | Cochrane . | |
| 4,658,977 | 4/1987 | Crisci . | |
| 4,660,735 | 4/1987 | Peschardt et al. . | |
| 4,790,448 | 12/1988 | Ostrum et al. . | |
| 4,798,301 | 1/1989 | Bullock et al. . | |
| 4,815,620 | 3/1989 | Bullock, III . | |
| 4,836,407 | 6/1989 | Bruce et al. | 220/276 |
| 4,930,656 | 6/1990 | Blanchette . | |
| 4,961,512 | 10/1990 | Von Holdt | 220/276 X |
| 4,984,701 | 1/1991 | Margaria . | |
| 5,042,680 | 8/1991 | Argudo et al. | 220/276 |
| 5,046,632 | 9/1991 | Bordner | 215/254 X |
| 5,092,478 | 3/1992 | La Pierre | 220/276 X |
| 5,238,135 | 8/1993 | Landis | 220/276 |
| 5,328,047 | 7/1994 | Smith . | |
| 5,373,955 | 12/1994 | Marino . | |
| 5,395,003 | 3/1995 | Matsuda | 220/270 |
| 5,460,287 | 10/1995 | Cargile et al. . | |

FOREIGN PATENT DOCUMENTS

| | | |
|---|---|---|
| 295 15 093 U1 | 1/1996 | Germany . |

*Primary Examiner*—Stephen K. Cronin
*Assistant Examiner*—Nathan Newhouse
*Attorney, Agent, or Firm*—Austin R. Miller

[57] ABSTRACT

A container assembly is provided including a cover and a container. The cover is securely engaged to the container by means of a primary lock to prevent removal of the cover from the container during handling. A secondary lock is also provided between the cover and the container. The secondary lock can be disengaged only after disengagement of the primary lock. The cover is readily removed by an end user of the container assembly.

20 Claims, 4 Drawing Sheets

COVER LOCKING MECHANISM

BACKGROUND OF THE INVENTION

This invention relates to a cover and container assembly. In particular, it relates to an assembly wherein the cover is securely locked to the container to prevent cover removal during handling, but wherein the cover is readily removable by an end user.

FIELD OF THE INVENTION

There is an ongoing demand for container assemblies capable of providing a secure lock between the cover and container. It is particularly desirable for container assemblies to withstand the forces caused by handling during shipment and storage. Containers are known to be inadvertently dropped, tipped, overstacked, and otherwise mishandled. It is important for container assemblies to maintain their integrity despite such mishandling.

Container assembly integrity is particularly important for plastic containers of relatively large size (e.g., 3.5 gallons or more) that are used to contain "Regulated Materials" (as defined by the United States Department of Transportation) such as toxic, corrosive, flammable and poisonous materials in liquid or non-liquid form. The United States Department of Transportation sets minimum performance requirements based on container contents. Similar requirements in the United States Code of Federal Regulations govern drop-tests, burst-strength and other standards to assure that containers will not burst or spill during shipment or during rough handling at filling or storage facilities. Although it is particularly important that containers filled with Regulated Materials adhere to governmental regulations, container integrity is of course desirable for many other uses as well.

At the same time, it is also desirable for container assemblies to have covers that are easily removable by end users. It is especially desirable for covers to be repeatedly removable and replaceable to allow access to container contents and subsequent resealing for storage.

OBJECTS OF THE INVENTION

It is an object of the invention to provide an improved locking mechanism for a container assembly.

It is another object of the invention to provide an assembly having a cover securely locked to a container to prevent removal of the cover from the container during handling.

Another object is to provide an assembly having a cover that is easily removable from a container by an end user.

It is yet another object of the invention to provide an assembly having a cover that is removable and replaceable.

Other objects will be apparent to those of skill in this art in view of the following descriptions.

SUMMARY OF THE INVENTION

A cover is provided for secure engagement to a container to prevent cover removal during handling. At the same time, the cover is readily removable by an end user.

A primary lock is provided between the cover and container to prevent inadvertent removal of the cover from the container during handling that occurs in the process of shipment and storage, for example. The primary lock is formed by engagement between a lower rib formed on a cover skirt and a lower flange formed on a container wall. The primary lock is released by removal from the cover skirt of a tear strip on which the lower rib is formed.

A secondary lock is provided between the cover and container to permit an end user to remove the cover from the container and to reclose the container assembly, if desired. The secondary lock is formed by engagement between an upper rib formed on the cover skirt and an upper flange formed on the container wall. The secondary lock is released by manipulating a grip portion on the cover skirt subsequent to removal of the tear strip and release of the primary lock.

DETAILED DESCRIPTION OF THE INVENTION

Figure 1:
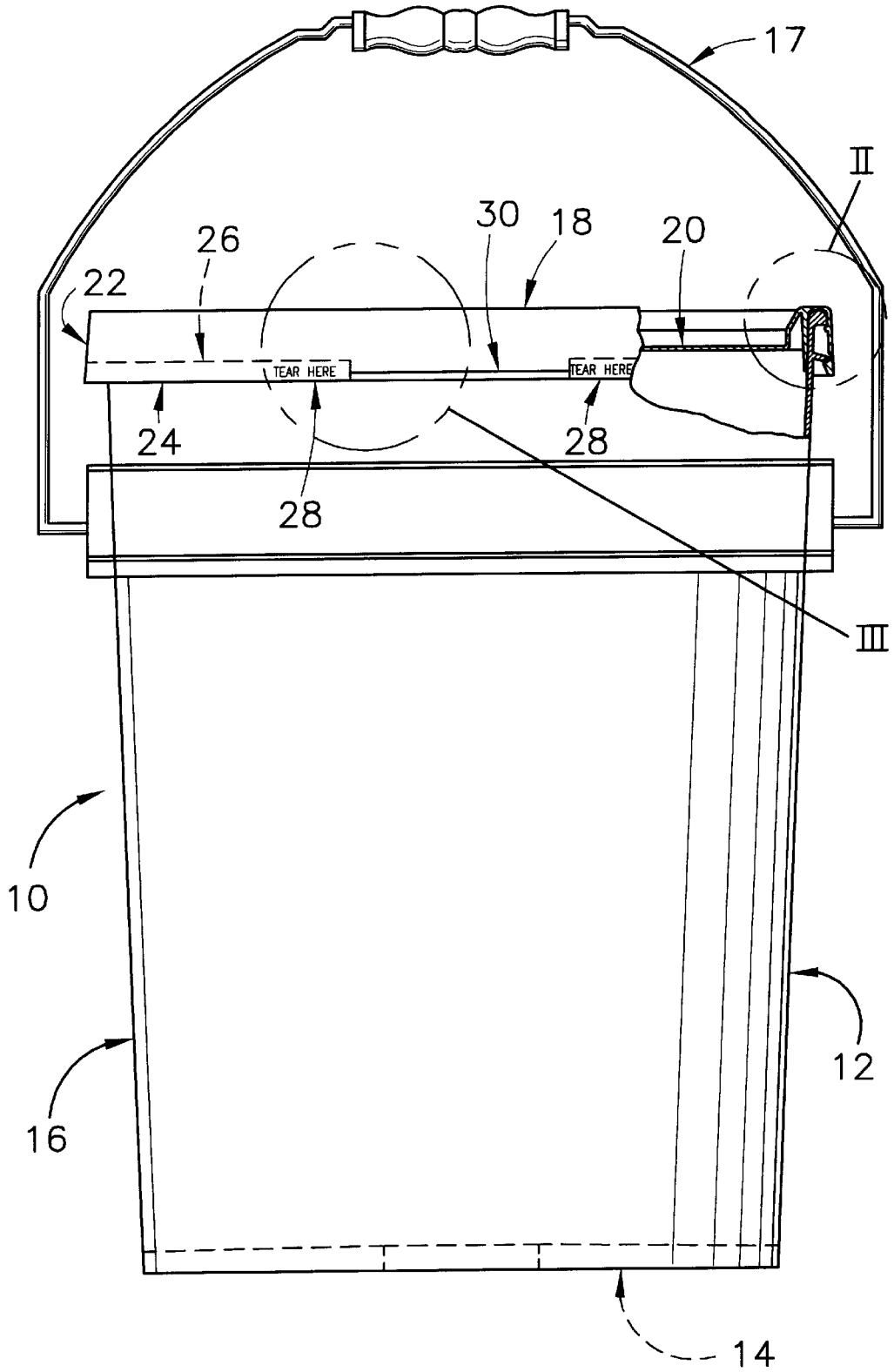
FIG. 1 is a side view of a container assembly embodying features of this invention.

The following description is intended to refer to the specific embodiment of this invention illustrated in the drawings. The description is not intended to define or limit the scope of the invention, which is defined separately in the claims that follow.

Referring to FIG. 1, the numeral "10" generally designates an embodiment of a container assembly according to this invention. Container assembly 10 includes a container 12, a handle 17 attached to container 12 and a cover 18 adapted for locking engagement to container 12. Container 12 and cover 18 are preferably formed from a suitable plastic by means of a molding process. Container 12 and cover 18 are most preferably formed from high-density polyethylene (HDPE), but are optionally formed from other suitable plastics such as low-density polyethylene (LDPE), polyethylene (PE), polypropylene (PP) and others. Such materials are preferably injection-molded to form container 12 and cover 18, utilizing known molding technologies.

Container 12 includes a bottom 14 and a wall 16 integrally formed with bottom 14 and extending upwardly from bottom 14. Container 12 is preferably cylindrical, but is optionally provided with any selected shape and in any selected size. Most preferably, container 12 is a five-gallon cylindrical pail. Also, container 12 is most preferably provided with a so-called "satellite ring" to enhance hoop strength. Further details of container 12 are described later with reference to FIG. 2.

Figure 2:
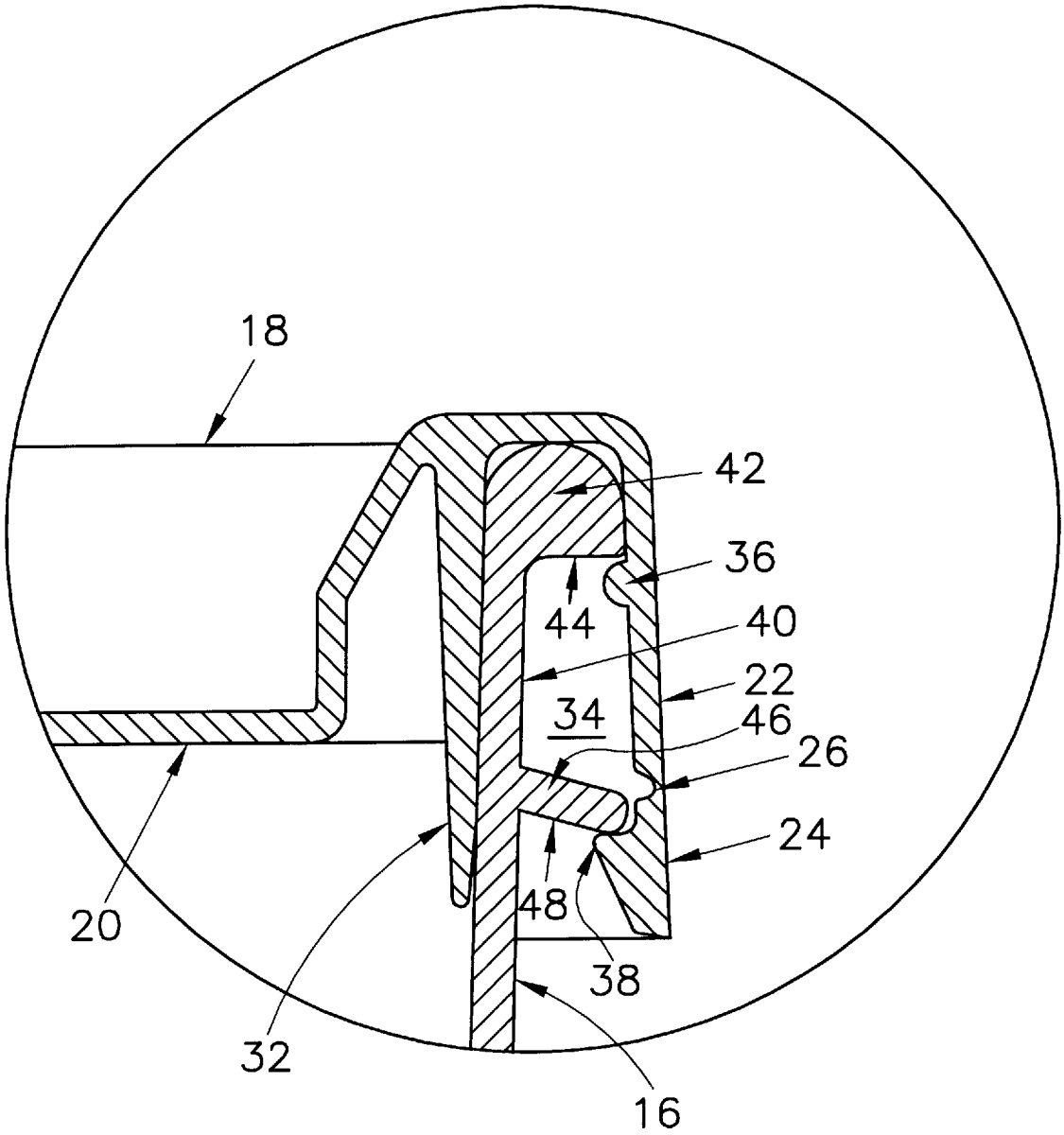
FIG. 2 is a cross-sectional side view of a detail of the container assembly embodiment shown in FIG. 1, as indicated in FIG. 1.

Cover 18 includes a cover body 20 shaped to extend across an opening at the top of container 12. At an outer perimeter of cover body 20 is formed a downwardly extending cover skirt 22. Formed integrally with cover skirt 22 is a tear strip 24 that extends around the majority of the circumference of cover skirt 22, but not around the entire circumference for reasons that will become clear later. Tear strip 24 is defined along its immediate upper edge by a tear line 26 that is preferably formed on an inside surface of cover skirt 22. Tear line 26 is preferably a continuous line of reduced material thickness (as shown in FIG. 2). Tear line 26 is optionally a line of perforations. In any form, tear line 26 permits removal of tear strip 24 by tearing cover skirt 22 along tear line 26. Tear strip 24 is preferably of constant height along its circumferential length. Also, tear strip 24 is preferably smooth (i.e., not serrated) to provide for easy handling. Most preferably, the only connection between tear strip 24 and the remainder of cover skirt 22 is along tear line 26 so that no material additional to that along tear line 26 connects tear strip 24 to cover 18, thereby facilitating easy removal of tear strip 24 by an end user of container assembly 10.

Two end portions 28 of tear strip 24 are preferably provided to assist an end user with removal of tear strip 24. End portions 28 of tear strip 24 are preferably reduced in thickness relative to the remainder of tear strip 24 to make it easier for an end user to initiate the tearing process that removes tear strip 24 from cover skirt 22.

Cover skirt 22 also includes a grip portion 30 extending to the bottom edge of cover skirt 22. Grip portion 30 occupies the circumferential portion of the bottom of cover skirt 22 that is left after removal of tear strip 24. Further details of grip portion 30 are described later with reference to FIGS. 3 and 4.

Referring now to FIG. 2, a cross-sectional view of a detail designated in FIG. 1 is shown. In the preferred embodiment of cover 18, a cover flange 32 extends downwardly from cover body 20 and radially extending ribs are preferably provided for support between the undersurface of cover body 20 and the inner surface of cover flange 32. An annular recess 34 is formed by the outer surface of cover flange 32, the lower surface of cover body 20, and the inner surface of cover skirt 22. Integrally formed on cover skirt 22 is an upper rib 36 which preferably extends continuously around the entire circumference of cover skirt 22. Upper rib 36 extends radially inwardly from the inside surface of cover skirt 22 and extends into annular recess 34.

FIG. 2 illustrates details of tear strip 24 formed at the bottom edge of cover skirt 22 as well as tear line 26 defined in the inner surface of cover skirt 22, which provides a border between tear strip 24 and the remainder of cover skirt 22. Formed on the inside surface of tear strip 24 is a lower rib 38 which preferably extends continuously along the length of tear strip 24. Lower rib 38 extends radially inwardly into annular recess 34. As described earlier, end portions 28 of tear strip 24 (shown in FIG. 1) are preferably thinner than the remainder of tear strip 24. Accordingly, lower rib 38 preferably extends along the entire length of tear strip 24, except that lower rib 38 is not formed on the inner surface of end portions 28 of tear strip 24.

At the upper-most end of container 12 is formed an upper portion 40 of wall 16. Upper portion 40 includes at its upper edge an upper flange 42 which is positioned adjacent to the opening in container 12. Upper flange 42 extends radially outwardly from wall 16 to form a so-called "pail curl." Upper flange 42 most preferably has a rounded top edge to provide a surface for sealing engagement against the lower surface of cover body 20. A gasket (not shown) is optionally placed between upper flange 42 and cover body 20 to supplement the seal, if desired. Upper flange 42 has a lower surface 44, the significance of which is made clear later.

Upper portion 40 of wall 16 also includes a lower flange 46 that extends outwardly from wall 16. As shown in FIG. 2, lower flange 46 preferably extends outwardly and downwardly. Most preferably, lower flange 46 forms a slight angle to the horizontal. For example, an angle of about 25 degrees is advantageous. Other angles, or no angle at all, are also contemplated. Lower flange 46 is axially spaced along wall 16 from upper flange 42. Lower flange 46 has a lower surface 48, the significance of which is described later.

When cover 18 is installed onto container 12 to form container assembly 10, the locking mechanism of this invention forms a seal to prevent leakage of contents from the container assembly, a primary lock to prevent cover removal during handling, and a secondary lock for cover removal and replacement by an end user. Details of each of these features are now described with reference to FIG. 2.

Application of cover 18 to container 12 creates a seal between cover 18 and container 12. Preferably, the outer surface of cover flange 32 sealingly contacts the inner surface of container wall 16. Also, the upper surface of upper flange 42 sealingly contacts the lower surface of cover body 20 at a location between cover skirt 22 and cover flange 32. Such points of contact provide a seal to prevent leakage or spillage of material from within container assembly 10.

A primary lock is formed between cover 18 and container 12 by engagement between lower rib 38 on tear strip 24 and lower surface 48 of lower flange 46 on container wall 16. This engagement is referred to as a "primary" lock because cover 18 cannot be removed from container 12 without first disengaging the lock formed between lower rib 38 and lower flange 46. Also, lower rib 38 of the primary lock preferably extends farther into annular recess 34 than upper rib 36 of the secondary lock, thereby providing a stronger lock because of increased interference between the cover rib and the container flange in the primary lock as compared to the secondary lock.

The secondary lock is formed between cover 18 and container 12 by engagement between upper rib 36 on cover skirt 22 and lower surface 44 of upper flange 42. This lock is considered a "secondary" lock because it cannot be removed until after the primary lock described above is disengaged. Also, engagement between upper rib 36 and upper flange 42 preferably creates a removable and replaceable lock of moderate strength, sometimes referred to in the industry as a "burp-type" lock or seal.

Figure 3:
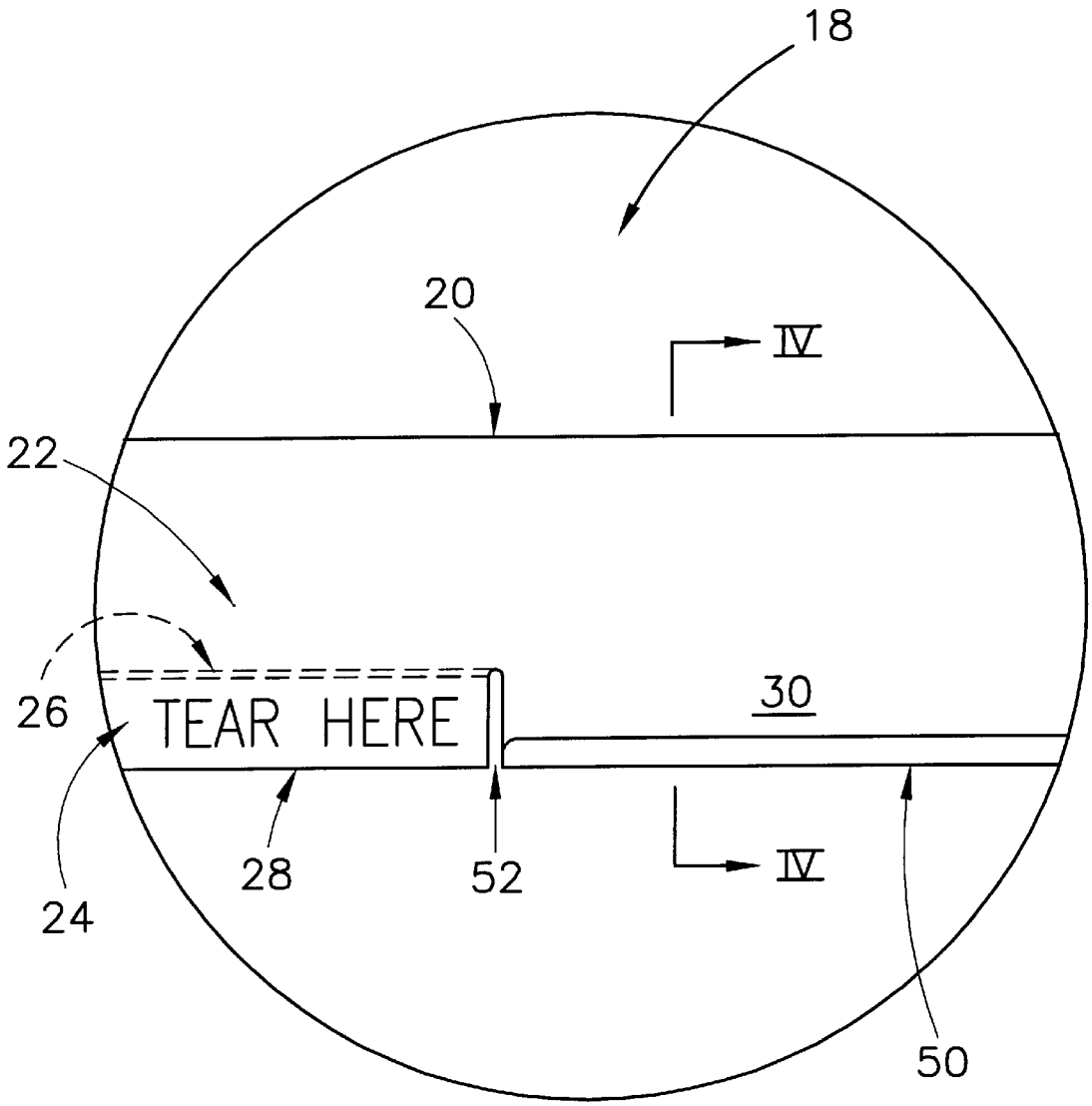
FIG. 3 is a side view of a detail of the container assembly embodiment shown in FIG. 1, as indicated in FIG. 1.
Figure 4:
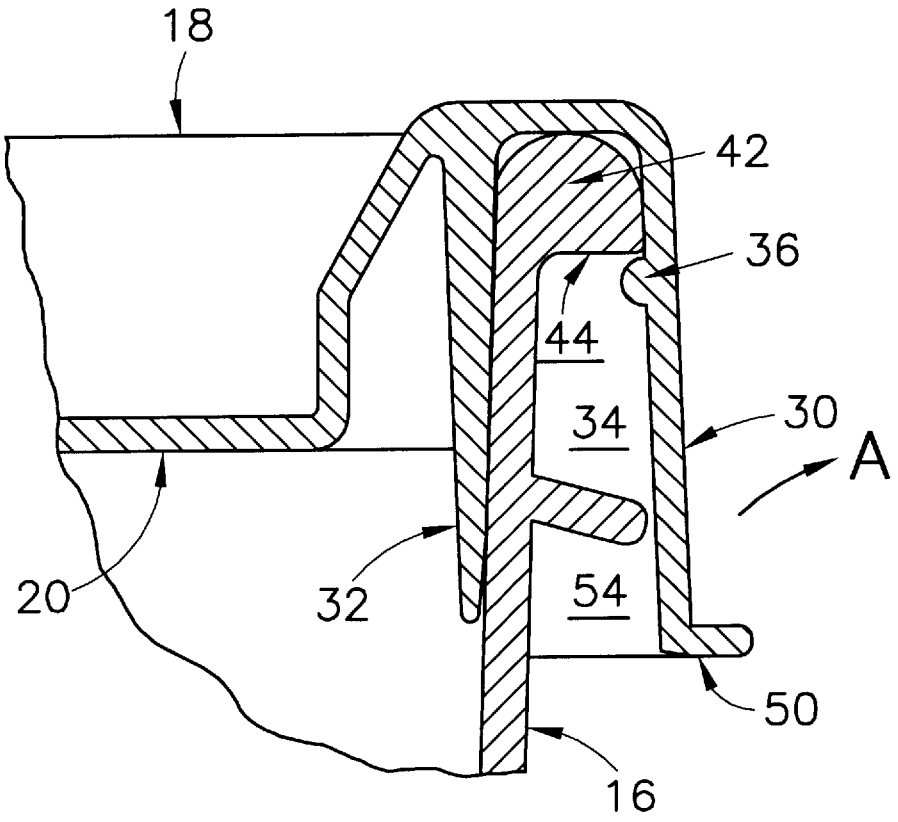
FIG. 4 is a cross-sectional side view of a detail of the container assembly embodiment shown in FIG. 1, as indicated in FIG. 3.

Referring to FIGS. 3 and 4, further details of cover skirt 22 are illustrated. Referring specifically to FIG. 3, tear strip 24, tear line 26 and one end portion 28 of tear strip 24 are illustrated. Tear line 26 is shown in phantom because it is preferably formed on the inside surface of cover skirt 22. The lettering "TEAR HERE", or a similar message, is preferably formed on end portions 28 of tear strip 24 to indicate to an end user the preferred locations from which the tearing operation is initiated.

Details of grip portion 30 are also illustrated in FIGS. 3 and 4. Grip portion 30 has at its lower-most edge a grip flange 50 that extends radially outwardly from cover skirt 22. Grip flange 50 provides a preferred surface against which the fingers of an end user can grasp cover 18 for cover removal, as is described later. A gap 52 is preferably provided between each side of grip portion 30 and end portions 28 of tear strip 24. Gaps 52 make it easier for an end user to begin the tearing process because the only material holding tear strip 24 to cover skirt 22 is along the frangible tear line 26. Removal of tear strip 24 merely requires a horizontal tear between tear strip 24 and cover skirt 22—no vertical tearing is required.

Referring specifically to FIG. 4, a cross-sectional view is provided at grip portion 30. The inside surface of grip portion 30 and the outside surface of wall 16 together define a passage 54 into which the fingertips of an end user are preferably placed to facilitate cover removal. Also, at least a portion of grip portion 30 is movable with respect to the remainder of cover assembly 10 in the outward and upward direction generally designated "A" in FIG. 4. Although upper rib 36 preferably continues through the circumferential portion of cover skirt 22 occupied by grip portion 30, FIG. 4 illustrates that lower rib 38 is preferably not formed on grip portion 30.

It is contemplated that more than one grip portion and more than one tear strip (one between each of multiple grip portions, for example) are optionally formed on the cover skirt.

Operation of container assembly 10 will now be described with general reference to FIGS. 1–4. Materials for shipment or storage are placed within the interior of container 12 in any known manner. Cover 18 is then applied to container 12 with a downward force until the cover locking mechanism is fully engaged. Preferably, cover 18 is forced downwardly onto container 12 until upper portion 40 of container 12 is inserted within annular recess 34 defined by cover 18. The upper surface of upper flange 42 then contacts the undersurface of cover body 20 and the inside surface of wall 16 contacts the outside surface of cover flange 32, thereby forming a leak-tight seal between cover 18 and container 12. Also, an upper surface of lower rib 38 engages lower surface 48 of lower flange 46, thereby engaging the primary lock. At substantially the same time, an upper surface of upper rib 36 engages lower surface 44 of upper flange 42, thereby engaging the secondary lock.

In this closed condition, container assembly 10 can be shipped, stored or otherwise handled until it is received by an end user. The combined effect of the primary lock, secondary lock and the leak-tight seal is to prevent spillage of contents from the container assembly and inadvertent cover removal.

In order to remove cover 18 from container 12, an end user first removes the primary lock. This is performed rather easily by the end user, without the use of any tools, by using his or her fingers to grasp tear strip 24 at one or both of end portions 28 and tearing cover skirt 22 along tear line 26 until tear strip 24 is completely separated from the remainder of cover skirt 22 (optionally, a portion of tear strip 24 remains attached). By this action, the primary lock is entirely disengaged because lower rib 38 is removed from cover 18 and from contact with lower surface 48 of lower flange 46. After removal of tear strip 24 and disengagement of the primary lock, the secondary lock remains in place to hold cover 18 on container 12.

In order to disengage the secondary lock and remove cover 18 from container 12, the end user places his or her fingertips within passage 54 and engages grip flange 50 of grip portion 30. A force is then applied by the user to move grip portion 30 in direction A (shown in FIG. 4). This action causes upper rib 36 to disengage from lower surface 44 of upper flange 42, beginning at the point directly above grip portion 30 of cover skirt 22. Continued movement of grip portion 30 causes complete disengagement of the secondary lock, until upper rib 36 passes to a position above upper flange 42, thereby permitting removal of cover 18 from container 12.

Once cover 18 is removed from container 12, the end user has access to the container interior. If desired, the end user can re-attach cover 18 to container 12 to protect and store any remaining container contents. To do so, the end user simply reengages the secondary lock by forcing cover 18 down onto container 12 until upper rib 36 on cover skirt 22 engages lower surface 44 of upper flange 42. Once re-engaged, the secondary lock provides a moderate seal between cover 18 and container 12. Such a seal is sufficient for at least short-term material storage. At the end of use, container assembly 10 is preferably recycled.

Many modifications are optionally made to the container assembly embodiment illustrated in the figures without departing from the spirit or scope of this invention. For example, modifications are optionally made to the container material, the container assembly size, and the shapes and configurations of the various container components. Also, modifications are optionally made to the configuration of the cover locking mechanism so long as the primary objectives of this invention are achieved.

Although the cover locking mechanism of this invention is most advantageously incorporated into container assemblies used for Regulated Materials, it is of course contemplated for advantageous use for a wide variety of applications. In any use, the cover locking mechanism is beneficial for material storage, material shipment and handling, tamper evidence, and so on.

In any embodiment, this invention provides a cover locking mechanism wherein a primary lock prevents cover removal during handling, wherein the primary lock is easily disengaged by an end user, and wherein a secondary lock permits an end user to remove and replace the cover after the primary lock is disengaged. Important features of this invention are defined in the following claims.

What is claimed is:

1. A locking mechanism for an assembly of a cover and a container, wherein said locking mechanism prevents removal of said cover from said container during handling of said assembly, said locking mechanism being easily disengaged by an end user of said assembly for removal of said cover from said container for access to an interior of said assembly, said cover having a cover body, a cover skirt extending downwardly from a perimeter portion of said cover body, and a tear strip at a bottom portion of said cover skirt and extending around all but a circumferential portion of said cover skirt, and said container having a container bottom and a container wall extending upwardly from said container bottom, wherein an upper portion of said container wall defines an opening, said locking mechanism comprising, in combination:

a primary lock preventing said removal of said cover from said container during said handling of said assembly, said primary lock being formed by engagement between (1) a lower circumferentially extending rib formed on an inner surface of said tear strip and extending inwardly from said tear strip, and (2) a lower annular flange formed on an outer surface of said upper portion of said container wall and extending outwardly from said container wall;

said primary lock being disengageable by removal of said tear strip from said cover skirt and removal of said lower rib on said tear strip from said lower annular flange on said container wall, wherein a grip portion integrally formed at said circumferential portion of said cover skirt remains connected to said cover skirt after said removal of said tear strip from said cover skirt and disengagement of said primary lock, and wherein an inner surface of said grip portion and an outer surface of said container wall together define a radial fingertip-width passage for fingertip access from below by said end user; and a secondary lock permitting removal of said cover from said container and replacement of said cover onto said container by an end user, said secondary lock being formed by engagement between (1) an upper rib formed on an inner surface of said cover skirt and extending inwardly from said cover skirt, said upper rib being axially spaced above said lower rib, and (2) an upper flange formed on said outer surface of said upper portion of said container wall and extending outwardly from said container wall, said upper flange being axially spaced above said lower flange;

wherein said lower rib of the primary lock extends inwardly from said cover skirt a greater distance than that which said upper rib of the secondary lock extends inwardly from said cover skirt, thereby providing increased interference in the primary lock as compared to the secondary lock;

said secondary lock being disengageable by disengagement of said primary lock, insertion of at least one fingertip into said fingertip-width passage defined between said grip portion and said container wall, movement of said grip portion on said cover skirt in a direction upward with respect to said container and outward away from said container, and removal of said upper rib on said cover skirt from said upper flange on said container wall.

2. The locking mechanism defined in claim 1, wherein said tear strip defines a bottom edge of said cover skirt along said circumferential portion of said cover skirt.

3. The locking mechanism defined in claim 2, wherein said tear strip has a substantially constant height along a circumferential length of said tear strip.

4. The locking mechanism defined in claim 1, wherein said upper rib on said cover skirt extends continuously around a circumference of said cover skirt.

5. The locking mechanism defined in claim 1, wherein said tear strip is defined by a tear line.

6. The locking mechanism defined in claim 5, wherein said tear line is a line of reduced material thickness defined by a recess formed in said inner surface of said cover skirt.

7. The locking mechanism defined in claim 1, wherein a substantially continuous vertical gap is defined in said cover skirt between said grip portion of said cover skirt and each end portion of said tear strip.

8. The locking mechanism defined in claim 1, wherein said lower rib on said tear strip extends inwardly from said cover skirt a greater distance than that which said upper rib on said skirt extends inwardly from said cover skirt, thereby providing increased interference in the primary lock as compared to the secondary lock.

9. The locking mechanism defined in claim 1, wherein said grip portion extends adjacent to a bottom edge of said cover skirt.

10. A cover for locking engagement to a container, said locking engagement preventing removal of said cover from said container during handling of said container, and said locking engagement permitting removal of said cover from said container by an end user for access to an interior of said container, said container having a container bottom, a container wall extending upwardly from said container bottom, and an opening defined by an upper portion of said container wall, said upper portion of said container wall including an upper flange extending outwardly from said container wall, said upper portion of said container wall also including a lower annular flange formed on said container wall and extending outwardly from said container wall and spaced axially below said upper flange, said cover comprising:

a cover body having a surface shaped to extend across said opening defined in said container;

a cover skirt extending downwardly from a perimeter portion of said cover body;

an upper rib extending inwardly from an interior surface of said cover skirt;

a tear strip formed on a bottom portion of said cover skirt, said tear strip terminating at end portions to define a discontinuity;

a lower circumferentially extending rib extending inwardly from an interior surface of said tear strip, said lower rib extending along at least a portion of the circumferential length of said tear strip, wherein said lower rib extends inwardly from said cover skirt a greater distance than that which said upper rib extends inwardly from said cover skirt thereby providing increased interference in the primary lock as compared to the secondary lock; and a grip portion formed on a bottom portion of said cover skirt at said discontinuity, wherein an inner surface of said grip portion and an outer surface of said container together define a radial fingertip-width passage for fingertip access from below by said end user;

wherein a primary lock is formed by engagement between said lower rib on said tear strip and said lower annular flange on said container wall, said primary lock being disengaged by removal of said tear strip from said cover skirt and separation of said lower rib on said tear strip from said lower flange on said container wall; and wherein a secondary lock is formed by engagement between said upper rib on said cover skirt and said upper flange on said container wall, said secondary lock being disengaged by disengagement of said primary lock, insertion of at least one fingertip into said fingertip-width passage defined between said grip portion and said container wall, movement of said grip portion on said cover skirt in a direction upward with respect to said container and outward away from said container, and separation of said upper rib on said cover skirt from said upper flange on said container wall.

11. The cover defined in claim 10, further comprising a cover flange extending downwardly from said cover body, said cover flange having an exterior surface positioned for contact with an interior surface of said container wall, wherein an interior surface of said cover skirt, an undersurface of said cover body and said exterior surface of said cover flange together define an annular recess shaped to receive said upper portion of said container wall.

12. The cover defined in claim 10, wherein said upper rib on said cover skirt extends continuously around a circumference of said cover skirt.

13. The cover defined in claim 10, wherein said tear strip on said cover skirt is defined by a tear line formed above said tear strip and wherein said tear strip defines a bottom edge of said cover skirt along said circumferential portion of said cover skirt.

14. The cover defined in claim 13, wherein said tear line is a line of reduced thickness defined by a recess formed in said interior surface of said cover skirt.

15. The cover defined in claim 10, further comprising a substantially continuous vertical gap defined in said cover skirt between said grip portion of said cover skirt and each of said end portions of said tear strip.

16. An assembly having a cover securely engaged to a container to prevent removal of said cover from said container during handling, said cover being readily removable from said container by an end user for access to an interior of said container, said assembly comprising:

a cover having a body and skirt extending downwardly from a perimeter of said body, said skirt defining an upper rib extending inwardly from an interior surface of said skirt, a tear strip at a bottom portion of said skirt extending around all but a circumferential portion of said skirt to define a discontinuity at said circumferential portion, a grip portion formed at said circumferential portion of said skirt and at a bottom portion of said skirt, said grip portion being located at said discontinuity, and a lower circumferentially extending rib extending inwardly from an interior surface of said tear strip, wherein said lower rib extends inwardly from said cover skirt a greater distance than that which said upper rib extends inwardly from said cover skirt, thereby providing increased interference in the primary lock as compared to the secondary lock;

a container having a bottom, a wall extending upwardly from said bottom, and a wall upper portion defining an opening, said wall upper portion defining an upper flange extending outwardly from said wall and a lower annular flange formed on said wall and axially spaced below said upper flange and extending outwardly from said wall;

a primary lock preventing removal of said cover from said container during said handling, said primary lock being formed by engagement between said lower rib on said tear strip and said lower flange on said wall upper portion, wherein said primary lock is released by removal of said tear strip from said skirt and separation of said lower rib on said tear strip from said lower flange on said wall upper portion; and a secondary lock permitting removal of said cover from said container by an end user for access to said interior of said container, said secondary lock being formed by engagement between said upper rib on said skirt and said upper flange on said wall upper portion, wherein said secondary lock is releasable, subsequent to release of said primary lock, by fingertip access from below into a radial fingertip-width passage defined between said grip portion on said skirt and said container wall, manipulation of said grip portion in a direction upwardly with respect to said container and outwardly away from said container, and separation of said upper rib on said skirt from said upper flange on said wall upper portion.

17. The assembly defined in claim 16, wherein said tear strip on said skirt is defined by a tear line formed above said tear strip and wherein said tear strip defines a bottom edge of said skirt along said circumferential portion of said skirt.

18. The assembly defined in claim 16, wherein said upper rib on said skirt extends continuously around a circumference of said skirt.

19. The assembly defined in claim 16, wherein said cover includes a substantially continuous vertical gap defined in said skirt between said grip portion of said skirt and each end portion of said tear strip.

20. The assembly defined in claim 16, wherein said lower flange extends outwardly and downwardly from said wall.

* * * * *